US007669613B2

(12) United States Patent
Egli

(10) Patent No.: US 7,669,613 B2
(45) Date of Patent: Mar. 2, 2010

(54) CONNECTING DEVICE FOR A WALL MIXER

(75) Inventor: Werner Egli, Hüntwangen (CH)

(73) Assignee: ARWA AG, Wallisellen (CH)

( * ) Notice: Subject to any disclaimer, the term of this patent is extended or adjusted under 35 U.S.C. 154(b) by 473 days.

(21) Appl. No.: 11/639,254

(22) Filed: Dec. 15, 2006

(65) Prior Publication Data

US 2007/0144593 A1 Jun. 28, 2007

(30) Foreign Application Priority Data

Dec. 15, 2005 (EP) ..... 05405698

(51) Int. Cl.
*F16K 11/02* (2006.01)

(52) U.S. Cl. ..... 137/625.4; 137/270; 137/580; 137/615

(58) Field of Classification Search ..... 137/269, 137/270, 625.41, 625.46, 580, 615, 625.4
See application file for complete search history.

(56) References Cited

U.S. PATENT DOCUMENTS 4,584,723 A * 4/1986 Hussauf ..... 4/696
4,676,270 A * 6/1987 Knapp et al. ..... 137/625.4
4,846,207 A * 7/1989 Humpert et al. ..... 137/15.18
5,325,887 A * 7/1994 Egli et al. ..... 137/270
5,806,552 A * 9/1998 Martin, Jr. ..... 137/270

FOREIGN PATENT DOCUMENTS

| | | |
|---|---|---|
| DE | 38 26 009 C2 | 3/1989 |
| DE | 38 26 064 A1 | 4/1989 |
| EP | 0 309 397 A | 3/1989 |
| GB | 2 405 187 A | 2/2005 |

OTHER PUBLICATIONS

European Search Report, Geisenhofer, M., May 16, 2006.

* cited by examiner

*Primary Examiner*—John Fox
(74) *Attorney, Agent, or Firm*—Sughrue Mion, PLLC

(57) ABSTRACT

A connecting device (100) for a wall mixer has a cold water inflow (2) and a hot water inflow (3), a mixer insert (5), a mixer cartridge (7) and an outlet (29). Mixed water is directed to outlet (29) regardless of the rotary position of the outlet.

10 Claims, 5 Drawing Sheets

CONNECTING DEVICE FOR A WALL MIXER

TECHNICAL FIELD

The present invention relates to the field of sanitary engineering. It relates to a connecting device for a wall mixer according to the preamble of Claim 1.

PRIOR ART

Connecting devices for wall mixers are known in many different forms. When fitting such connecting devices, which each have an inflow for hot water and cold water and an outflow for the mixed water, a situation may occur in which the feed lines for cold and hot water that are directed to the connecting devices are transposed and/or are rotated about a common axis.

In the past, therefore, connecting devices have already been proposed with which rotation and/or transposing of the feed lines for cold and hot water can be compensated for. Thus, for example, publication DE-C2-38 26 009 shows a connecting device in which the mixing fitting, irrespective of the orientation of the water feed lines for cold and hot water, can be oriented in the desired manner and can additionally be varied in its distance from the wall.

In this known solution, however, the mixed-water outflow is fixed in direction with respect to the fitted mixer; i.e. the mixed-water outflow cannot be rotated with respect to the mixer.

DESCRIPTION OF THE INVENTION

The object of the invention is therefore to provide a connecting device for a wall mixer in which the mixer and the mixed-water outflow can be secured in their position irrespective of the angular position of the two water inflows—cold and hot water—and in which in particular the mixed-water outflow can be secured in its position irrespective of the angular position of the mixer.

This object is achieved by all the features of Claim 1 in their entirety. The invention is based on a housing which can be fastened to the masonry or the installation wall and has a cold-water inflow and a hot-water inflow, on a mixer insert which is rotatable relative to the housing about an axis disposed perpendicularly to the masonry or the installation wall and which is provided for accommodating a mixer cartridge and is connected to the housing in such a way that, irrespective of the rotary position of the mixer insert about the axis, cold water is always directed in the same manner from the cold-water inflow and hot water is always directed in the same manner from the hot-water inflow to the mixer cartridge, and on means which direct the resulting mixed water from the mixer cartridge to an outlet for the mixed water. To achieve the object stated, provision is now made for the outlet to be rotatable relative to the housing and relative to the mixer insert about the axis and for it to be connected to the mixer insert in such a way that, irrespective of the rotary position of the outlet and of the mixer insert about the axis, the mixed water is always directed in the same manner from the mixer cartridge to the outlet.

A preferred configuration of the invention is characterized in that, for directing the water between the housing, the mixer insert and the outlet irrespective of the rotary angle, a plurality of annular passages arranged concentrically to the axis are provided.

A development of the invention is characterized in that the housing has a coaxial blind bore, in that the mixer insert is of cylindrical design and is rotatably mounted with the one end in the blind bore of the housing in such a way that a free space remains at the bottom of the blind bore, in that the mixer insert, at the other end, has a receptacle part for accommodating the mixer cartridge, in that a first longitudinal bore which connects the receptacle part to the free space runs inside the mixer insert, in that a first concentric annular passage is arranged in the blind bore between the mixer insert and the housing, in that a second longitudinal bore which connects the receptacle part to the first annular passage via a first transverse bore leading to the first annular passage runs inside the mixer insert, and in that the cold-water inflow is connected via a first oblique bore to the first annular passage and the hot-water inflow is connected to the free space via a second oblique bore.

Another development of the invention is characterized in that the housing has a hollow-cylindrical section in the region of the mixer insert in the blind bore, in that the housing is concentrically enclosed in the hollow-cylindrical section by a mixed-water outflow which is mounted so as to be rotatable relative to the housing about the axis, in that a second concentric annular passage is arranged in the hollow-cylindrical section in the blind bore between the mixer insert and the housing, in that the second concentric annular passage is enclosed by a third concentric annular passage which is arranged between the housing and the mixed-water outflow, in that mixed-water outflow has an outlet opening which is connected to the third annular passage via a second transverse bore and runs radially outwards, in that the second and the third annular passage are connected to one another by a third transverse bore in the housing, and in that a longitudinal passage which connects the receptacle part to the second annular passage via a fourth transverse bore leading to the second annular passage runs inside the mixer insert.

The mixed-water outflow can preferably be rotated by 360° about the axis and is secured with one or more screws.

Furthermore, the outlet can be inserted with its one end into the outlet opening in a sealing manner and can be secured there, preferably by means of a screw.

In particular, it is advantageous if the annular passages and if need be the free space are sealed by concentrically arranged O-rings.

Another configuration of the invention is characterized in that the cold-water inflow and the hot-water inflow are designed as nozzles on the housing which are parallel to one another and are oriented perpendicularly to the axis.

Another configuration of the invention is characterized in that a cover plate is provided for covering the connecting device, and in that that part of the mixer insert which projects from the cover plate is covered with a sleeve. In this case, an O-ring is arranged between the sleeve and the mixer insert for fixing the sleeve on the mixer insert.

BRIEF EXPLANATION OF THE FIGURES

The invention is to be explained in more detail below with reference to exemplary embodiments in connection with the drawing, in which.

WAYS OF IMPLEMENTING THE INVENTION

Figure 1:
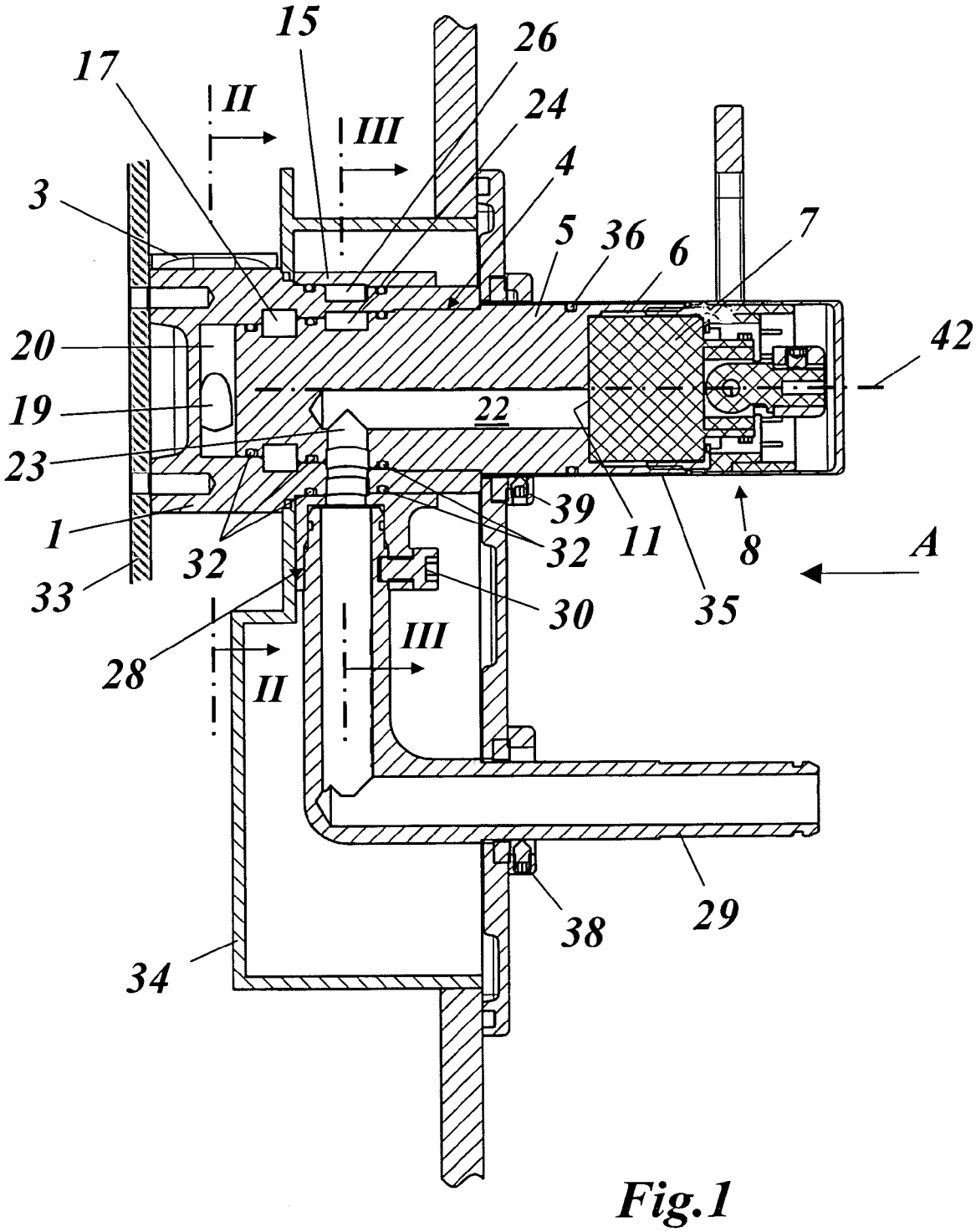
FIG. 1 shows a longitudinal section through the connecting device according to a preferred exemplary embodiment of the invention.
Figure 2:
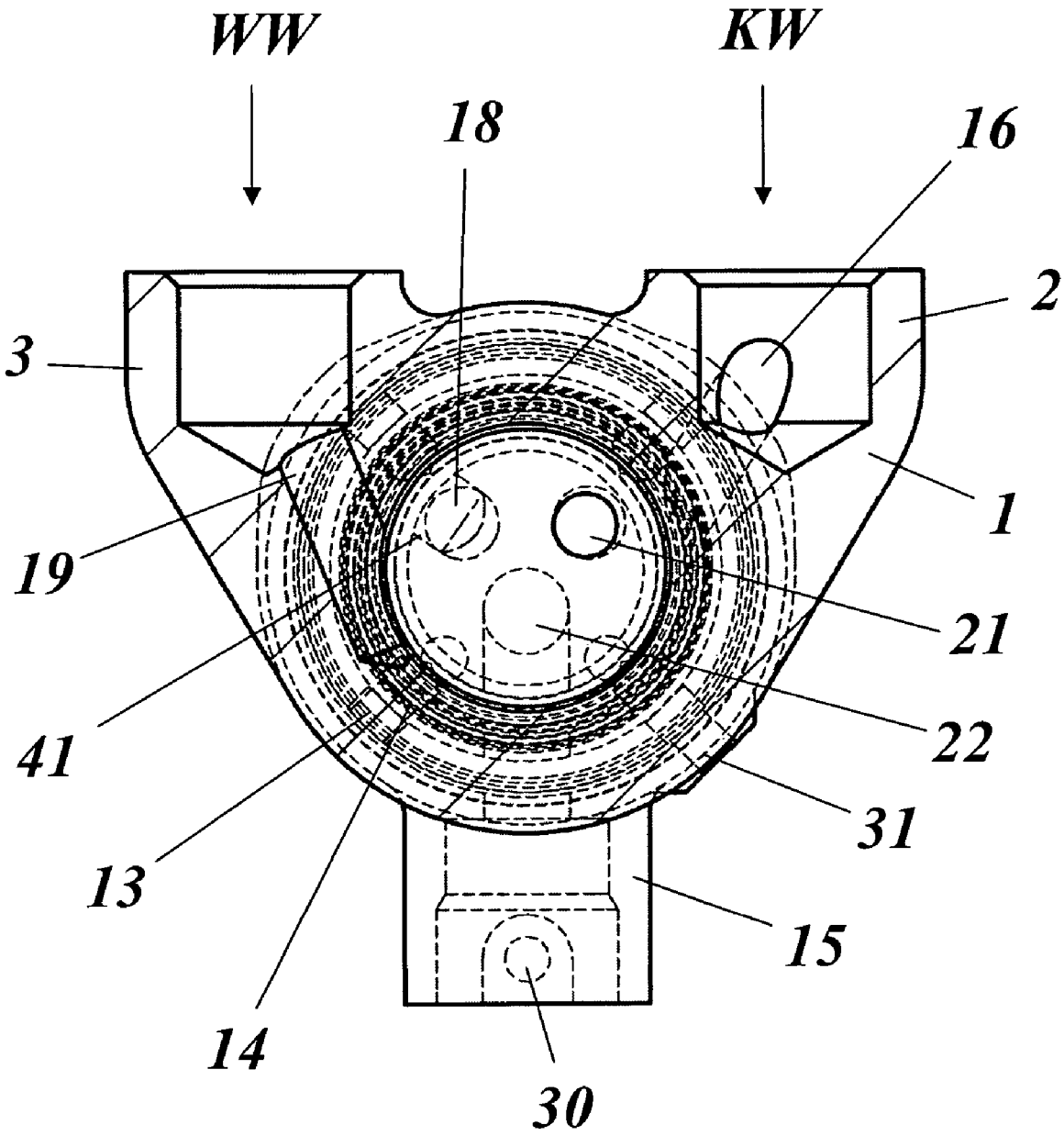
FIG. 2 shows a cross section along line II-II in FIG. 1.
Figure 3:
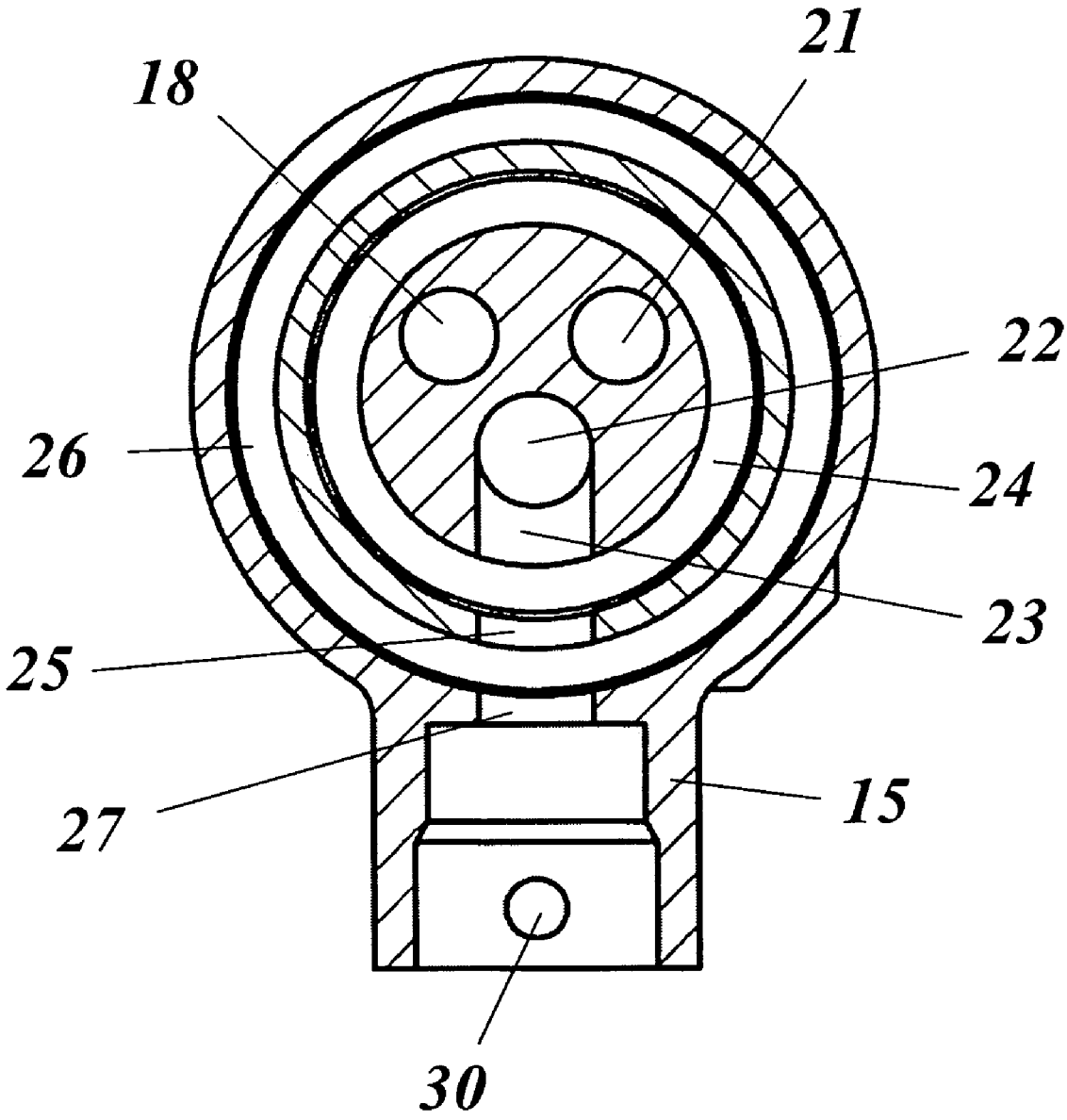
FIG. 3 shows a cross section along line III-III in FIG. 1.
Figure 5:
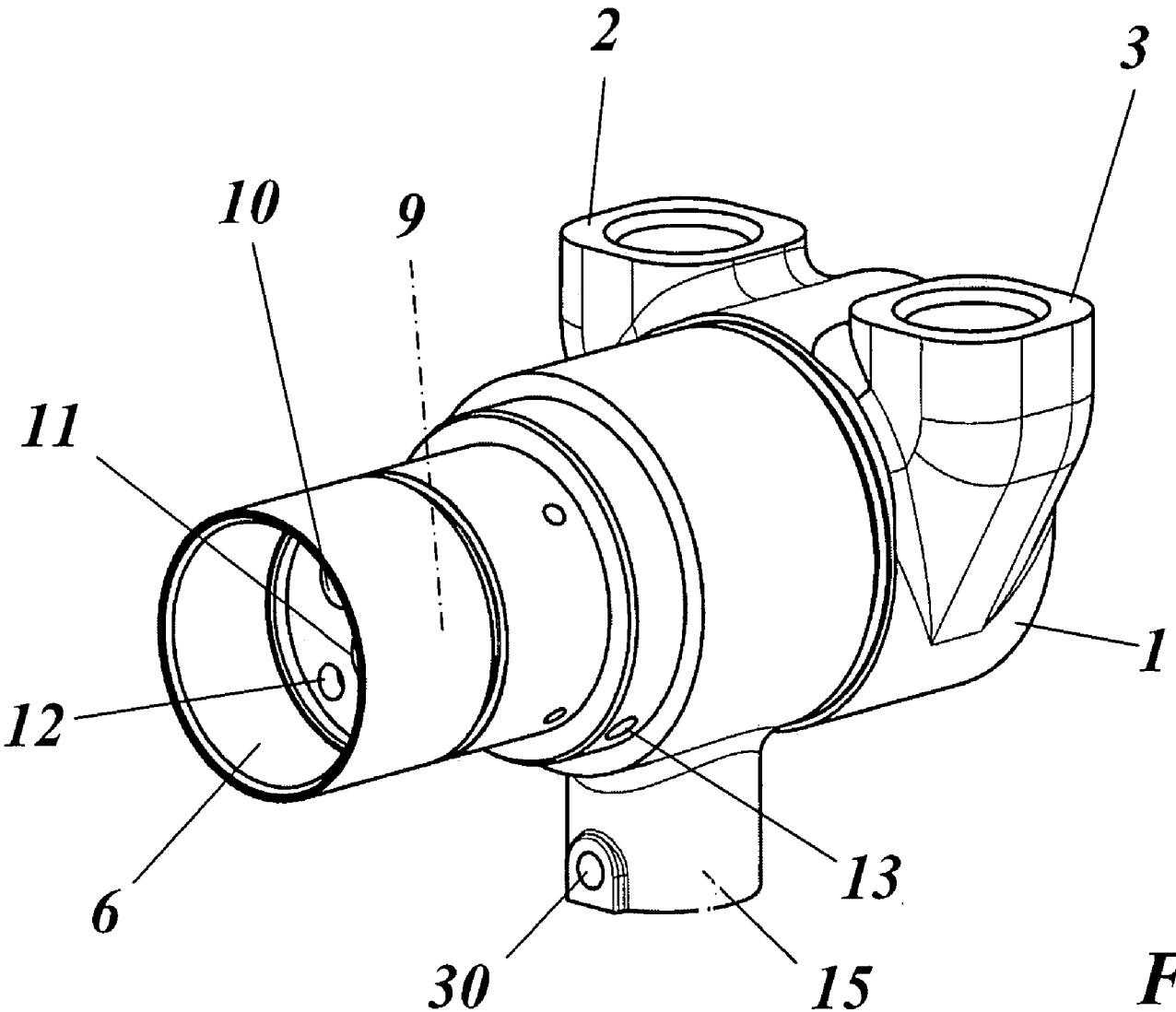
FIG. 5 shows a perspective view of housing, mixer insert and mixed-water outflow of the example from FIG. 1.

In the exemplary embodiment of the invention according to FIG. 1, the connecting device 100 comprises a housing 1 (also see FIGS. 2 and 5) having the two nozzles for cold-water inflow 2 and hot-water inflow 3. The housing 1 has an axis 42 and a coaxial, stepped blind bore 4, into which a mixer insert 5 is pushed in a matching and sealed manner. The insert 5 has a receptacle part 6 for fitting a commercially available mixer cartridge 7. The complete actuating device, which is likewise commercially available, is designated by 8.

At the bottom, the receptacle part 6 has a respective inflow bore for cold water 9 and hot water 10, a bore for mixed water 11 and two bores 12 for fixing pins.

Designated by 13 is a fixing screw with which the position of the mixer insert 5 relative to the housing 1 is fixed. Since the fixing bore 14 can be drilled in any desired manner (an encircling groove is also conceivable), the position of the housing 1 relative to the mixer insert 5 is conceivable at any desired angle with respect to the axis 42. The rotatable, mixed-water outflow is designated by 15.

The incoming cold water flows from the cold-water inflow 2 through an oblique bore 16 into an annular passage 17 and from there through a short first transverse bore 41 into the longitudinal bore 18 which end in the inflow bore for cold water 9.

The incoming hot water flows from the hot-water inflow 3 through an oblique bore 19 into the space 20 between housing 1 and mixer insert 5. From there, the hot water flows through the continuous longitudinal bore 21 which ends in the inflow bore for hot water 10.

The mixed water flows from the bore 11 into a longitudinal passage 22 parallel to the axis and from there through a second transverse bore 23 into an inner annular passage 24 concentric to the axis 42. From there, a third transverse bore 25 leads into a concentric outer annular passage 26. This annular passage is connected by a fourth transverse bore 27 to an outlet opening 28 in the mixed-water outflow 15. An outlet 29 is inserted into the outlet opening 28 and is secured with a screw 30.

The mixed-water outflow 15, which is rotatable by 360° about the axis 42, is secured with one or more screws 31.

The three annular passages 17, 24 and 26 are sealed by O-rings 32. Designated by 33 is at least one fastening bracket, by means of which the housing 1 is fastened to the masonry or to an installation wall.

Designated by 34 is a plastic housing which is used as a protective casing.

The mixer insert 5 is covered with a sleeve 35, it being possible for this sleeve 35 to have any desired form on the outside or any desired color or surface structure. An O-ring 36 arranged between sleeve 35 and mixer insert 5 serves to ensure certain firm seating of the sleeve 35.

Figure 4:
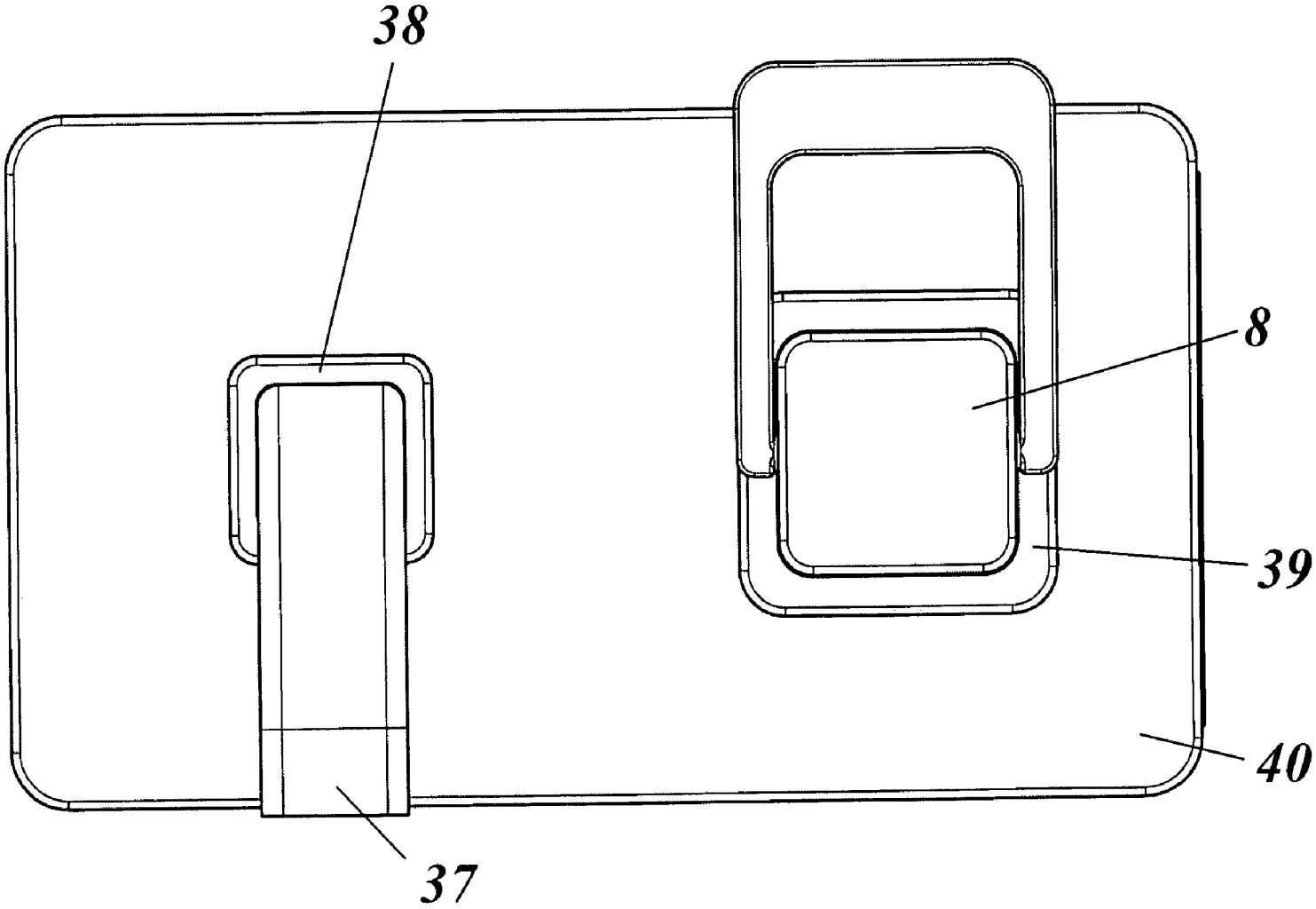
FIG. 4 shows a view in direction A in FIG. 1.

A view in the direction of A (axial direction) is shown in FIG. 4, the mixer being arranged on the right in this case and the (outer) outlet 37 on the left. Other arrangements in which, for example, the mixer and the outer outlet 37 change positions or are arranged perpendicularly one above the other are possible with the same parts without any problems.

The outer outlet 37, the outlet rosette 38 around the outer outlet 37, the actuating device 8, a rosette 39 for the mixer, and a cover plate 40 for the entire connecting device 100 are of square or rectangular design in this case.

If another design is desired, e.g. round, these visible parts can be exchanged, while retaining all the inner parts. The same also applies to other surface structures or other colours.

On the whole, the present invention aims to achieve a connecting device for a wall mixer, in which the following objects are achieved:

- The two water inflows—cold and hot water—can be fed at any desired rotary angle with respect to the position of the mixer.
- The mixed-water outflow can in turn be directed away at any desired rotary angle with respect to the position of the mixer.
- This point permits, for example in a simple manner with the same parts, the three embodiment variants:
  mixer at the top, outlet at the bottom
  mixer on the right, outlet on the left
  mixer on the left, outlet on the right
- This point also enables the mixer to fitted in any desired rotary position.
- Any desired design variants and color variants can be produced by simple exchange of individual visible parts, e.g. cover sleeve, rosettes and outlet.

LIST OF DESTINATIONS

1 Housing
2 Cold-water inflow
3 Hot-water inflow
4 Blind bore (stepped)
5 Mixer insert
6 Receptacle part
7 Mixer cartridge
8 Actuating device
9 Inflow bore (cold water)
10 Inflow bore (hot water)
11 Bore (mixed water)
12 Bore (fixing pin)
13 Fixing screw
14 Fixing bore
15 Mixed-water outflow (rotatable)
16, 19 Oblique bore
17 Annular passage
18, 21 Longitudinal bore
20 Space
22 Longitudinal passage
23, 25, 27, 41 Transverse bore
24 Annular passage (inner)
26 Annular passage (outer)
28 Outlet opening
29 Outlet
30, 31 Screw
32, 36 O-ring
33 Fastening bracket
34 Plastic housing (protective casing)
35 Sleeve
37 Outlet
38 Outlet rosette
39 Rosette
40 Cover plate
42 Axis
100 Connecting device

The invention claimed is:

1. A connecting device for a wall mixer for fitting in masonry or for fastening to an installation wall, comprising:

a housing adapted to be fastened to the masonry or the installation wall and having a cold-water inflow, a hot-water inflow and a mixed-water outflow;

a mixer insert accommodated in the housing in a manner to be rotatable relative to the housing about an axis disposed perpendicularly to the masonry or the installation wall, when the connecting device is installed, the mixer insert being adapted to accommodate a mixer cartridge, the mixer insert comprising a first and a second inflow passage and an outflow passage and the mixer insert being connected to the housing in such a way that, irrespective of the rotary position of the mixer insert about the axis, cold water is always directed in the same manner from the cold-water inflow through the first inflow passage to the mixer cartridge and hot water is always directed in the same manner from the hot-water inflow through the second inflow passage to the mixer cartridge; and an outlet member arranged on the housing, the outlet member being rotatable relative to the housing and relative to the mixer insert about the axis, the outlet member comprising an outlet opening, wherein a plurality of annular passages are defined between the mixer insert, the housing and the outlet member concentrically to the axis for always directing the resulting mixed water in the same manner from the mixing cartridge through the outflow passage of the mixer insert and through the mixed-water outflow of the housing to the outlet opening of the outlet member irrespective of the rotary position of the outlet member and of the mixer insert relative to the housing about the axis.

2. The connecting device according to claim 1, wherein the housing has a coaxial blind bore, wherein the mixer insert is of cylindrical design with a first and a second end and is rotatably mounted with its first end in the blind bore of the housing in such a way that a free space remains between the first end of the mixer insert and the bottom of the blind bore, wherein the mixer insert has a receptacle part at its second end for accommodating the mixer cartridge, wherein the mixer insert defines a first longitudinal bore on its inside, which connects the receptacle part to the free space, wherein a first concentric annular passage is defined in the blind bore between the mixer insert and the housing, wherein the mixer insert defines a first transverse bore and a second longitudinal bore on its inside, which second longitudinal bore connects the receptacle part to the first transverse bore which in turn connects the second longitudinal bore to the first annular passage, and wherein the mixer insert defines a first and a second oblique bore, which first oblique bore connects the cold-water inflow to the first annular passage, and which second oblique bore connects the hot-water inflow to the free space.

3. The connecting device according to claim 2, wherein the housing has a hollow-cylindrical section in the region of the mixer insert in the blind bore, wherein the housing is concentrically enclosed in the hollow-cylindrical section by the outlet member which is mounted so as to be rotatable relative to the housing about the axis, wherein a second concentric annular passage is defined in the hollow-cylindrical section in the blind bore between the mixer insert and the housing, wherein the second concentric annular passage is enclosed by a third concentric annular passage which is defined between the housing and the outlet member, wherein the outlet member has an outlet opening wherein the outlet member defines a second transverse bore, connecting the outlet opening in radial direction to the third annular passage, wherein the housing defines a third transverse bore connecting the second and the third annular passage to one another, and wherein the mixer insert defines a fourth transverse bore and a longitudinal passage on its inside, which longitudinal bore connects the receptacle part to the transverse bore which in turn connects the longitudinal bore to the second annular passage.

4. The connecting device according to claim 3, wherein the outlet member is rotatable by 360° about the axis and is secured with one or more screws.

5. The connecting device according to claim 3, wherein the outlet member is inserted with its one end into the outlet opening in a sealing manner and is secured there.

6. The connecting device according to claim 5, wherein the outlet member is secured at its one end inside the outlet opening by means of a screw.

7. The connecting device according to claim 1, wherein the annular passages are sealed by concentrically arranged O-rings.

8. The connecting device according to claim 1, wherein the cold-water inflow and the hot-water inflow are designed as nozzles on the housing which are parallel to one another and are oriented perpendicularly to the axis.

9. The connecting device according to claim 1, wherein a cover plate is provided for covering the connecting device, wherein the mixer insert comprises a part which projects from the cover plate and wherein this part is covered with a sleeve.

10. The connecting device according to claim 9, wherein an O-ring is arranged between the sleeve and the mixer insert for fixing the sleeve on the mixer insert.

* * * * *